US005718327A

United States Patent [19]

Wu

[11] Patent Number: 5,718,327

[45] Date of Patent: Feb. 17, 1998

[54] KEY SWITCH FOR A KEYBOARD

[76] Inventor: Donald Wu, 12F., No. 59, Chang Chun Road, Taipei, Taiwan

[21] Appl. No.: 811,962

[22] Filed: Mar. 5, 1997

[51] Int. Cl.[6] ..... H01H 13/70

[52] U.S. Cl. ..... 200/344; 200/345; 200/512

[58] Field of Search ..... 200/344, 341, 200/345, 512, 513, 520

[56] References Cited

U.S. PATENT DOCUMENTS

| | | | |
|---|---|---|---|
| 5,115,106 | 5/1992 | Weiland et al. | 200/512 |
| 5,386,091 | 1/1995 | Clancy | 200/344 |
| 5,396,038 | 3/1995 | Yamada | 200/344 |

*Primary Examiner*—David J. Walczak

*Attorney, Agent, or Firm*—Jacobson, Price, Holman & Stern, PLLC

[57] ABSTRACT

A key switch including a key base having a circular upright bearing defining a first axial hole and a second axial hole around the first axial hole, a key cap having a first downward tube inserted into the first axial hole of the base and a second downward tube inserted into the second axial hole of the key base, a membrane circuit mounted on the flat base of the key base around the upright bearing, and a rubber mounted on the membrane circuit around the upright bearing of the key base to support the key cap above the key base and having a plunger portion spaced around the upright bearing of the key base and forced by the key cap to trigger the membrane circuit when the key cap is depressed, causing it to produce an electric signal.

2 Claims, 5 Drawing Sheets

KEY SWITCH FOR A KEYBOARD

BACKGROUND OF THE INVENTION

The present invention relates to key switches for computer keyboards, and more particularly to such a key switch which for a keyboard to be used in flat electronic products for example notebook computers.

FIG. 1 shows a key switch for a computer keyboard according to the prior art. This structure of key switch comprises a key body 80 having a tubular upright bearing 81 defining a receiving chamber 811, a rubber cone 82 mounted within the receiving chamber 811 on a membrane circuit 84 above a metal frame 83, a flange 85 mounted in the receiving chamber 811 at the top and having two through holes 86, and a key cap 87 mounted on the tubular upright bearing 81 and having plungers 88 inserted into the through holes 86. The plungers 88 have a respective hook 89 for hooking on the through holes 86 at the bottom. Because the plungers 88 of the key cap 87 are guided by the flange 85, the flange 85 must have a certain height so that the key cap 87 can be moved stably. Therefore, this structure of key switch has a certain height.

FIG. 2 shows another structure of key switch according to the prior art. This structure of key switch comprises a key base 90 mounted on a membrane circuit 94 above a metal frame 93, a key holder 91 disposed in a hole in the key base 90, a rubber ring 92 mounted around the key holder 91, a key cap 96, and two substantially U-shaped leg members 95 mounted on the key holder 91 to hold the key cap 96 above the key holder 91. This structure of key switch is comprised of a lot of parts, therefore its manufacturing cost is high, and its assembly process is complicated.

SUMMARY OF THE INVENTION

The present invention provides a key switch which eliminates the aforesaid drawbacks. According to one aspect of the present invention, the key switch comprises a key base having a circular upright bearing defining a first axial hole and a second axial hole around the first axial hole, a key cap having a first downward tube inserted into the first axial hole of the base and a second downward tube inserted into the second axial hole of the key base, a membrane circuit mounted on the flat base of the key base around the upright bearing, and a rubber mounted on the membrane circuit around the upright bearing of the key base to support the key cap above the key base and having a plunger portion spaced around the upright bearing of the key base and forced by the key cap to trigger the membrane circuit when the key cap is depressed, causing it to produce an electric signal. According to another aspect of the present invention, the first downward tube and second downward tube of the key cap are respectively disposed in contact with the periphery of the first axial hole and second axial hole of the key base, so that a friction force is produced between the first downward tube and second downward tube of the key cap and the periphery of the first axial hole and second axial hole of the key base to keep the key cap to be moved stably.

DETAILED DESCRIPTION OF THE PREFERRED EMBODIMENT

Figure 1:
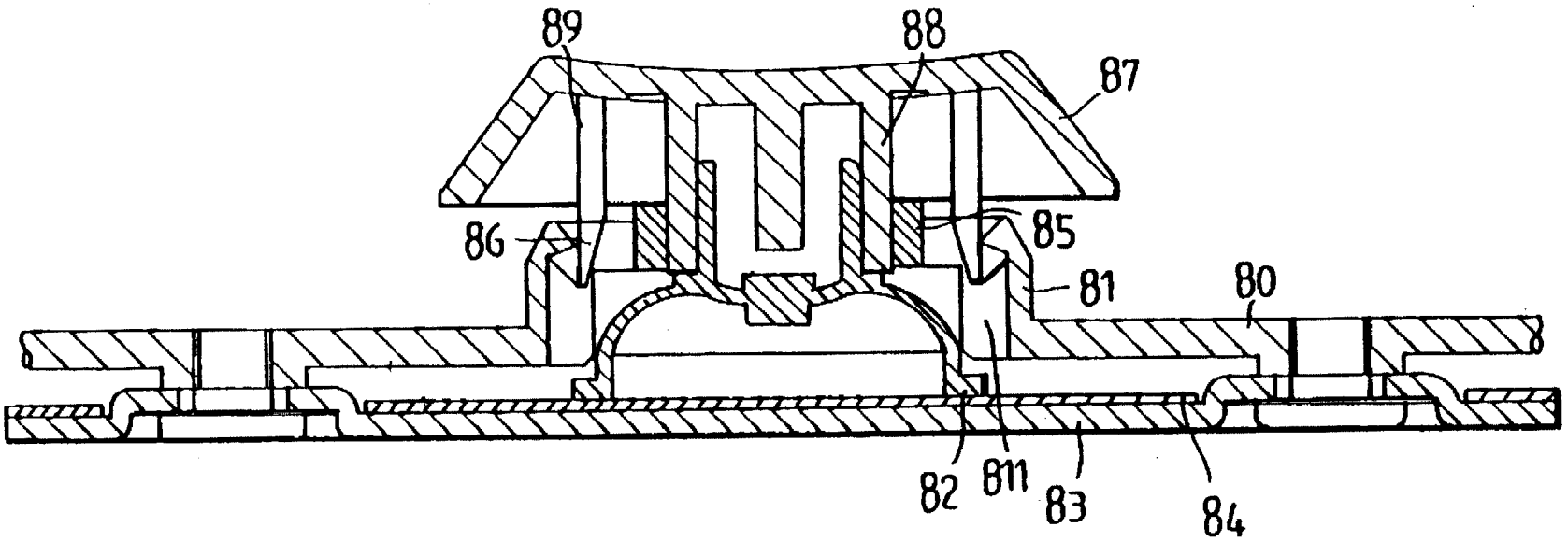
FIG 1 PRIOR ART
FIG. 1 is a sectional view of a key switch according to the prior art.
Figure 2:
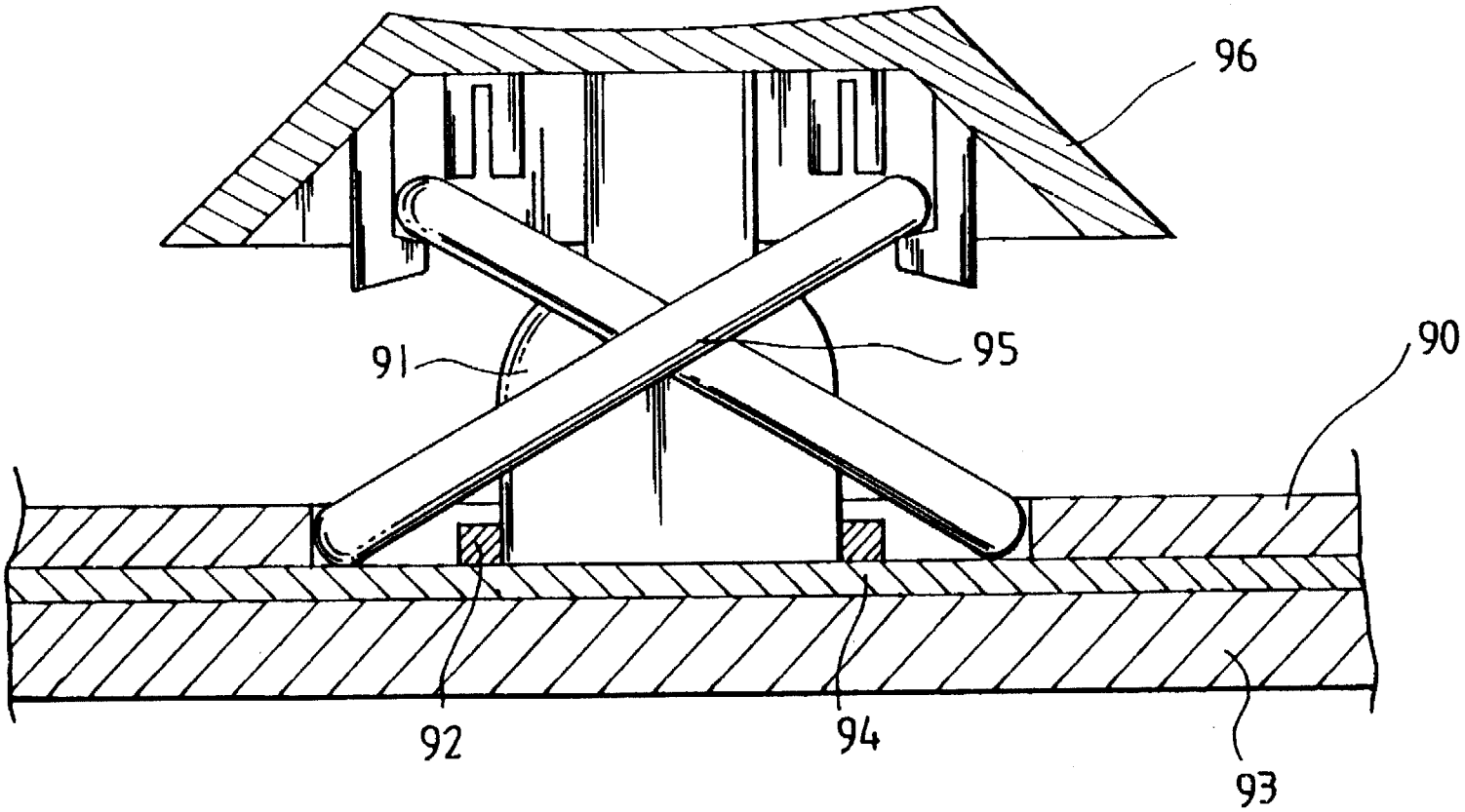
FIG 2 PRIOR ART
FIG. 2 is a sectional view of another structure of key switch according to the prior art.
Figure 3:
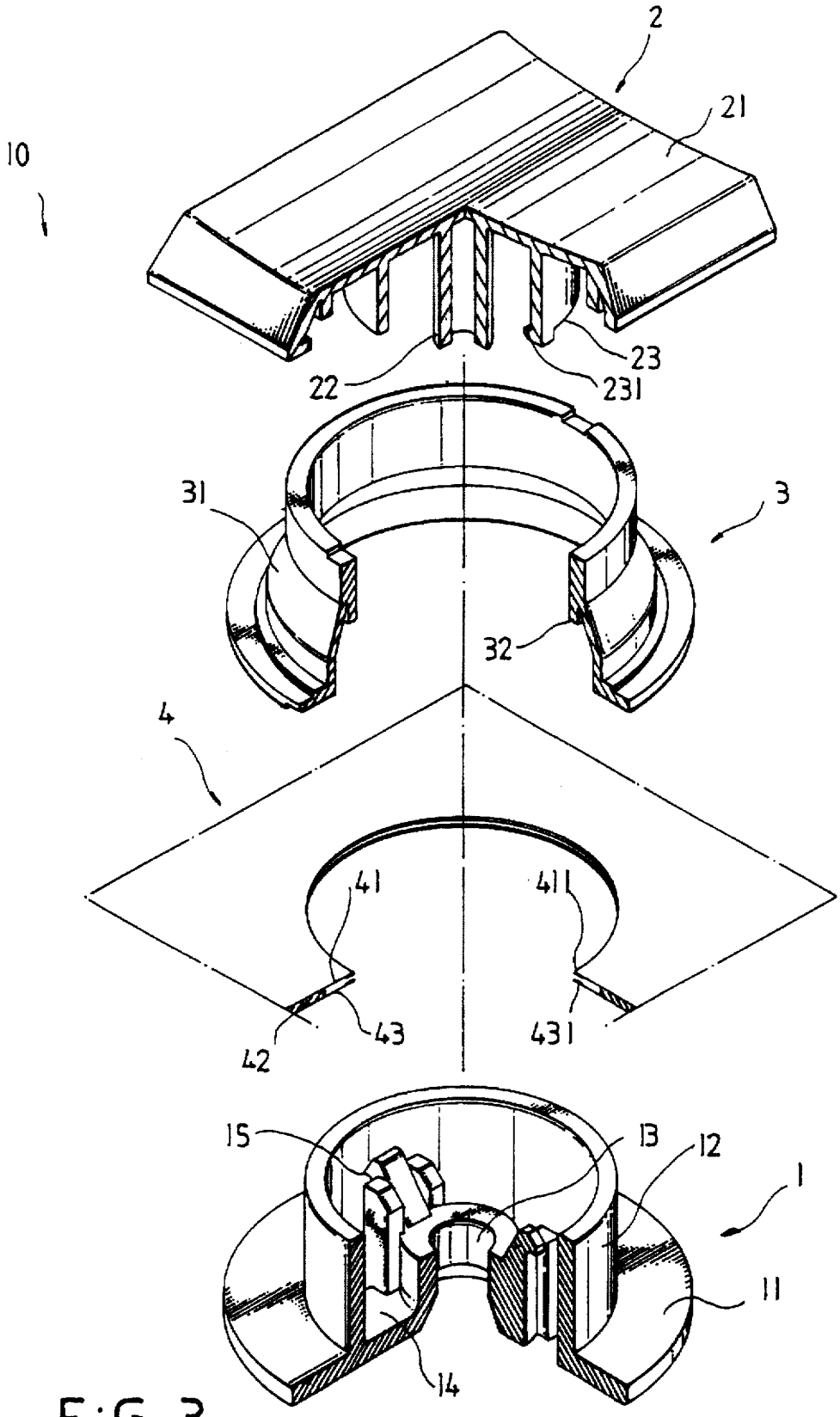
FIG. 3 is an exploded view of a key switch according to the present invention.
Figure 4:
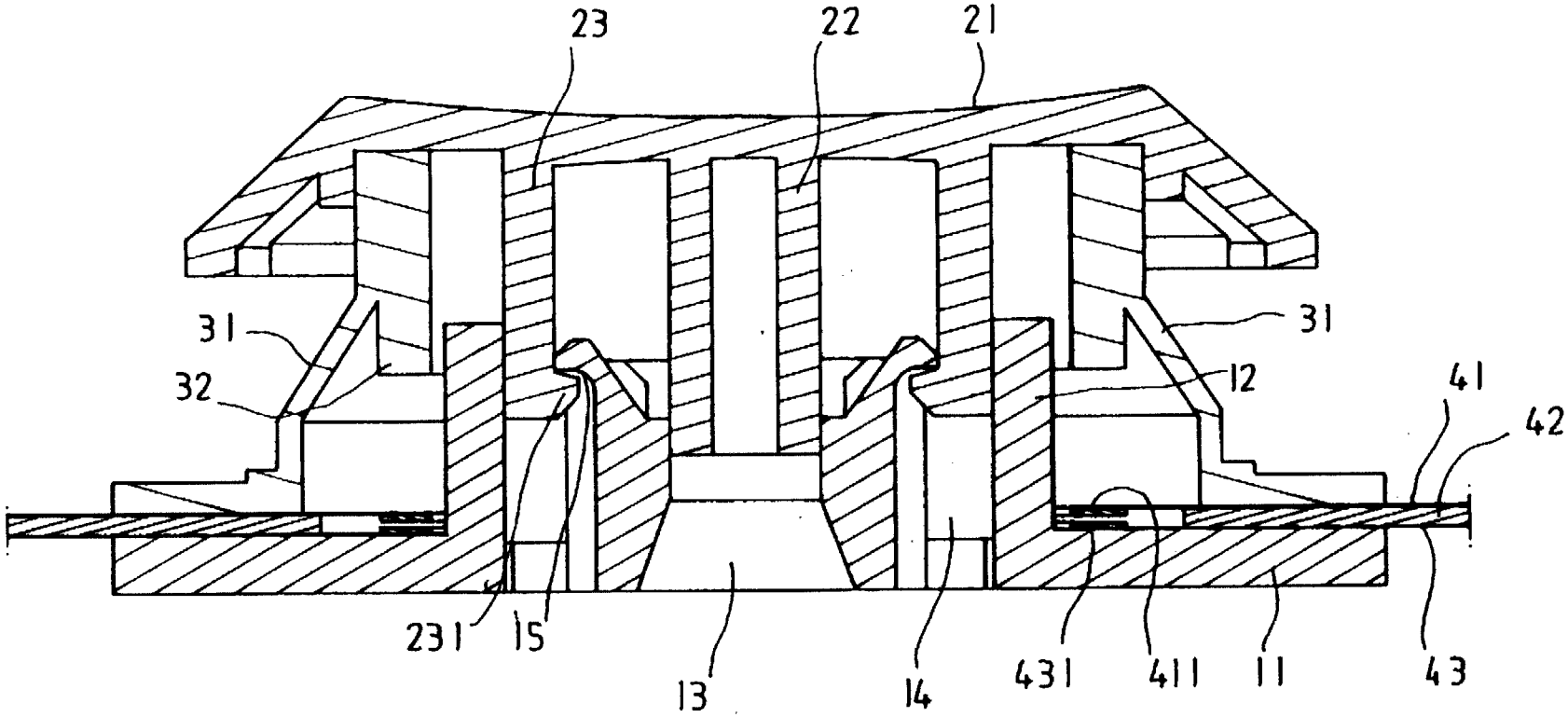
FIG. 4 is a sectional assembly view of the key switch shown in FIG. 3.

Referring to FIGS. 3 and 4, a key switch 10 in accordance with the present invention comprises a key base 1, a key cap 2, a rubber 3, and a membrane circuit 4.

The key base 1 comprises a flat base 11, a circular upright bearing 12 raised from the flat base 11 and defining a first axial hole 13 and a second axial hole 14 concentrically disposed around the first axial hole 13, and a plurality of hooks 15 from the periphery of the first axial hole 13 and upwardly projecting into the second axial hole 14.

The key cap 2 comprises a substantially rectangular cap body 21, a first downward tube 22 downwardly extended from the cap body 21 at the center and adapted for inserting into the first axial hole 13 of the keys base 1, and a second downward tube 23 downwardly extended from the cap body 21 around the first downward tube 22 and adapted for inserting into the second axial hole 14 of the key base 1. The second downward tube 23 of the key cap 2 has an inwardly disposed hook portion 231 at the bottom adapted for hooking up with the hooks 15 of the key base 1.

The rubber 3 comprises a tubular body 31 mounted on the of the key base 1 around the upright bearing 12 to support the key cap 2 above the key base 1 and a plunger portion 32 spaced around the upright bearing 12.

The membrane circuit 4 is mounted on the key base 1 around the upright bearing 12 and retained between the tubular body 31 of the rubber 3 and the flat base 11 of the key base 1 and comprised of three rubber layers, namely, the top rubber layer 41, the bottom rubber layer 43, and the intermediate rubber layer 42. The top rubber layer 41 has a circuit 411 printed thereon at the bottom side. The bottom rubber layer 43 has a circuit 431 printed thereon at the top side. The plunger portion 32 of the rubber 3 is suspended above a part of the membrane circuit 4 where the intermediate rubber layer 42 does not reach. Therefore, when the key cap 2 is depressed to deform the rubber 3, the plunger portion 32 is forced to press the top rubber layer 41 against the bottom rubber layer 43, causing the circuits 411; 431 to be connected.

Figure 5:
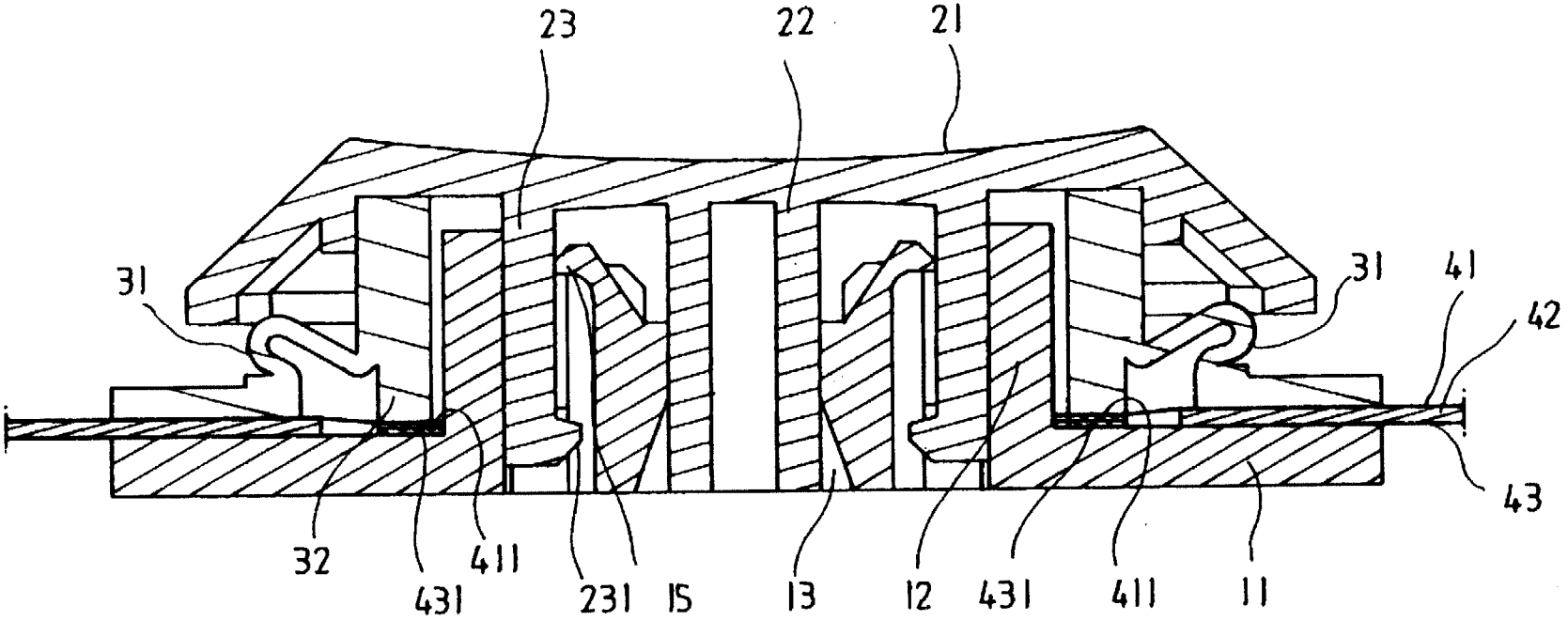
FIG. 5 is similar to FIG. 4 but showing the key cap depressed.

Referring to FIGS. 4 and 5, when the key cap 2 is pressed down, the first downward tube 22 and the second downward tube 23 are respectively moved downward in the first axial hole 13 and second axial hole 14 of the key base 1. The friction force between the first downward tube 22 and second downward tube 23 of the key cap 2 and the periphery of the first axial hole 13 and second axial hole 14 of the key base 1 enables the key cap 2 to be moved stably. When the key cap 2 is moved to the lower limit, the rubber 3 is deformed, and the plunger portion 32 of the rubber 3 presses the top rubber layer 41 against the bottom rubber layer 43, causing the membrane circuit 4 to produce an electric signal to the host computer (see FIG. 5). When the key cap 2 is released, the rubber 3 immediately returns to its former shape to push the key cap 2 upwardly back to its former position, thereby causing the hooked portion 231 of the key cap 2 to be forced into engagement with the hooks 15 of the key base 1 again, and therefore the key cap 2 does not disconnect from the key base 1 (see FIG. 4).

Because the rubber 3 and the membrane circuit 4 are respectively mounted on the flat base 11 of the key base 1 around the upright bearing 12, the total height of the key switch 10 is minimized. Furthermore, the whole design of the key switch 10 is simple, therefore its manufacturing cost is low.

While only one embodiment of the present invention has been shown and described, it will be understood that various modifications and changes could be made thereunto without departing from the spirit and scope of the invention disclosed.

What the invention claimed is:

1. A key switch comprising:

a key base having a flat base, a circular upright bearing raised from said flat base and defining a first axial hole and a second axial hole concentrically disposed around said first axial hole;

a key cap having a first downward tube downwardly extended from said cap body at a center portion thereof and inserted into the first axial hole of said key base, and a second downward tube downwardly extended from said cap body around said first downward tube and inserted into the second axial hole of said key base;

a membrane circuit mounted on the flat base of said key base around said upright bearing; and a rubber having a tapered, tubular body mounted on said membrane circuit around the upright bearing of said key base to support said key cap above said key base, and a plunger portion raised from said tapered, tubular body from an inside portion thereof and spaced around the upright bearing of said key base and forced by said key cap to trigger said membrane circuit when said key cap is depressed, causing said key cap to produce an electric signal.

2. The key switch of claim 1 wherein the second downward tube of said key cap has a bottom end terminating in an inwardly disposed hook portion; said key base comprises hook means suspending in said second axial hole adapted for hooking up with the hook portion of said key cap to hold said key cap in place when said key cap is released.

* * * * *